US006402487B1

(12) United States Patent
Clements et al.

(10) Patent No.: US 6,402,487 B1
(45) Date of Patent: Jun. 11, 2002

(54) CONTROL SYSTEM FOR VARIABLE EXHAUST NOZZLE ON GAS TURBINE ENGINES

(75) Inventors: Martin A. Clements, Parma; E. Kent Miller, Kirtland, both of OH (US)

(73) Assignee: Argo-Tech Corporation, Cleveland, OH (US)

( * ) Notice: Subject to any disclaimer, the term of this patent is extended or adjusted under 35 U.S.C. 154(b) by 0 days.

(21) Appl. No.: 09/638,685

(22) Filed: Aug. 14, 2000

Related U.S. Application Data

(60) Provisional application No. 60/148,827, filed on Aug. 13, 1999.

(51) Int. Cl.[7] ..... E03C 2/00

(52) U.S. Cl. ..... 418/26; 418/24; 418/25; 418/27; 418/31

(58) Field of Search ..... 418/24, 25, 26, 418/27, 31; 417/220

(56) References Cited

U.S. PATENT DOCUMENTS

| | | | | |
|---|---|---|---|---|
| 1,670,229 A | | 6/1928 | Balsiger | |
| 2,631,544 A | | 3/1953 | Wilcox | |
| 2,685,255 A | * | 8/1954 | Carner | 418/31 |
| 3,112,709 A | | 12/1963 | Yarmak | |
| 3,547,562 A | * | 12/1970 | Cynor | 418/31 |
| 3,560,118 A | | 2/1971 | Palachik | |
| 3,604,823 A | | 9/1971 | Thomas | |
| 3,663,130 A | | 5/1972 | Lincks | |
| 3,672,796 A | | 6/1972 | Mitchell | |
| 3,784,326 A | | 1/1974 | Lagana et al. | |
| 4,325,215 A | * | 4/1982 | Yamamoto | 417/220 |
| 4,390,328 A | * | 6/1983 | Fickelscher | 418/45 |
| 4,406,599 A | | 9/1983 | Stephan | |
| 4,439,117 A | | 3/1984 | Bunger | |
| 4,445,830 A | | 5/1984 | Woodruff | |
| 5,316,450 A | | 5/1994 | Kast | |
| 5,378,112 A | | 1/1995 | Nasvytis | |
| 5,545,014 A | | 8/1996 | Sundberg et al. | |
| 5,571,243 A | * | 11/1996 | Arnold et al. | 417/206 |
| 6,022,201 A | * | 2/2000 | Kasmer | 418/24 |

FOREIGN PATENT DOCUMENTS

| | | |
|---|---|---|
| DE | 2 004 300 | 11/1970 |
| DE | 30 01 673 A1 | 1/1980 |
| WO | WO 97/43518 | 11/1997 |

* cited by examiner

*Primary Examiner*—Thomas Denion
*Assistant Examiner*—Theresa Trieu
(74) *Attorney, Agent, or Firm*—Fay, Sharpe, Fagan, Minnich & McKee, LLP

(57) ABSTRACT

The present invention relates to a system that provides independently operated or controlled circuits in a single device. An exemplary application adapts a variable displacement roller pump into an engine geometry control system that uses one circuit of the pump during start-up and then removes the circuit from the system and satisfies other pumping needs with the other circuit of the pump.

6 Claims, 4 Drawing Sheets

CONTROL SYSTEM FOR VARIABLE EXHAUST NOZZLE ON GAS TURBINE ENGINES

This application claims the benefit of and hereby expressly incorporates by reference U.S. Provisional Application Serial No. 60/148,827, filed on Aug. 13, 1999.

BACKGROUND OF THE INVENTION

1. Field of the Invention

The present invention relates to a single device having independently controlled circuits and, more particularly, a pump having first and second independently controlled circuits. It finds particular application as a control system for a variable displacement pump used in an engine geometry control system and, more particularly, to an improved control system for a variable exhaust nozzle on a gas turbine engine and will be described with particular reference thereto. However, it will be appreciated that the present invention is also amenable to other like applications.

2. Discussion of the Art

Engine geometry control systems are in widespread use on modern aircraft turbine engines. Engine geometry controls are used for various actuation of IGV, VSV, VBV, VEN, and other subsystem actuators. Additionally, engine geometry control systems are often required to provide engine start flow.

Engine geometry control systems are generally required to have the capability to control high pressure to either a rod end or piston end of an actuation system. This usually requires the high pressure side of a fluid source to be switched from the rod end to the head end of an actuator, or vice versa.

Switching from one end to the other is generally accomplished by using appropriate control valves to switch the high and low pressure of the fluid supply as demanded by the engine geometry requirements. Depending on the number of actuators to be handled in a given system, the flow change may be accomplished by valves in the supply system or by valves in the actuator. The valves serve to switch the inlet and discharge flow sources.

Generally, the fluid flow source or pumping system must be a variable displacement pump to minimize input power and heat loss due to the high pressures required. The control system response must be fast enough to enable changes from minimum flow to full stroke flow in a very short period. Minimum flow condition is often only needed to supply leakage makeup or cooling flow, whereas full stroke flow is often needed during takeoff or times of maximum actuator movement. The time limitation for the change to occur is dependent on the system needs and the number of actuators being serviced.

Heretofore, high pressure pumps have generally been limited to piston pumps of various configurations. However, these pumps often require extra complexity and expense in order to meet the high pressure and low lubricity fuel requirements of aircraft engine jet fuels. Further, these pumps have not had a history of high reliability.

In any case, the pumping system may be self pressure compensated or externally servo controlled. A pressure compensated pumping system is capable of maintaining a fixed discharge pressure while supplying only the flow needed by the load system. A servo controlled variable displacement pump can vary both the flow and pressure in response to the load system needs.

A variation of a servo control method is to use an over-center servo pump. An over-center servo pump is capable of switching its inlet and discharge porting in response to system demands. A major drawback of the over-center servo pump is that it is normally limited to a piston type pump design and is often unduly complex when discharge pressure requirements reach the 3000–5000 psid range.

Another major drawback of prior art systems is that the components of the system are often numerous, voluminous, heavy and have experienced maintenance problems.

Accordingly, there is a need for an engine geometry control system that does not suffer the disadvantages of the prior art and overcomes the above-referenced drawbacks.

BRIEF SUMMARY OF THE INVENTION

The present invention relates to a system that provides two independently controllable circuits from a single device. An exemplary embodiment of the present invention relates to an improved control system for a variable exhaust nozzle on a gas turbine engine.

In accordance with the present invention, a housing includes a rotor and a split cam ring that defines first and second independent pump circuits. Each circuit is independently controllable.

One advantage of the present invention is the provision of an improved control system for a variable exhaust nozzle on a gas turbine engine which provides a simplified system integration.

Another advantage of the present invention is the provision of an improved control system that enhances performance and stability.

Yet another advantage of the present invention is the provision of an improved control system that enhances service life and reliability.

Still another advantage of the present invention is the provision of an improved control system that is less heavy, less voluminous and less costly than prior art systems.

A still further advantage of the present invention is the provision of an improved control system that reduces system complexity with improved stability.

Another advantage of the present invention is the provision of an improved control system that reduces system temperature.

Further advantages and benefits of the present invention will become apparent to those of ordinary skill in the art upon reading and understanding the following detailed description of the preferred embodiment.

BRIEF DESCRIPTION OF THE DRAWINGS

The invention may take form in various components and arrangements of components, and in various steps and arrangements of steps. The drawings are only for purposes of illustrating the presently preferred embodiments and are not to be construed as limiting the invention.

DETAILED DESCRIPTION OF THE INVENTION

Figure 1:
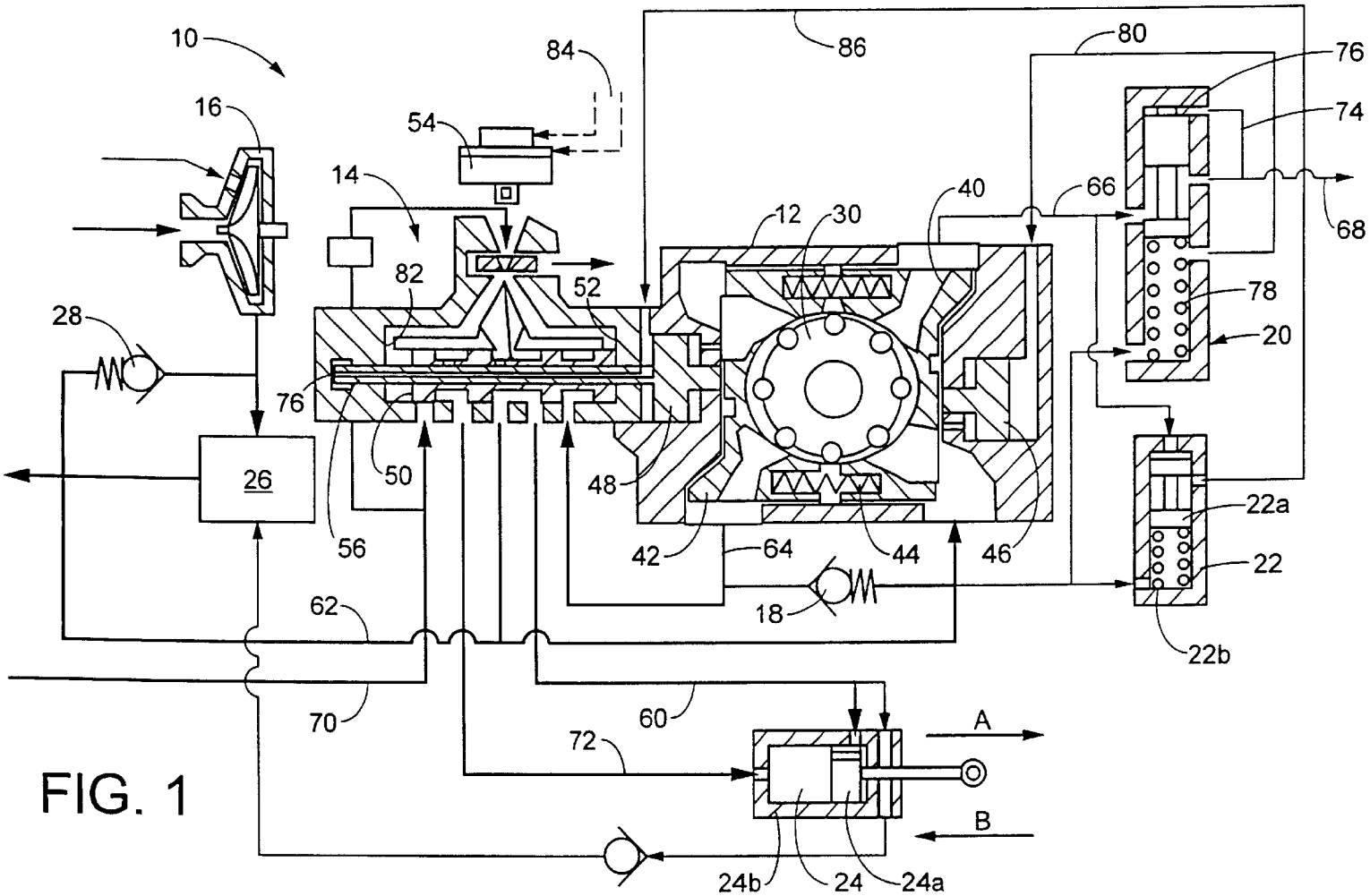
FIG. 1 is a pumping system schematic illustrating a control system for a variable exhaust nozzle on a gas turbine engine in an engine starting mode in accordance with a first preferred embodiment of the present invention.
Figure 2:
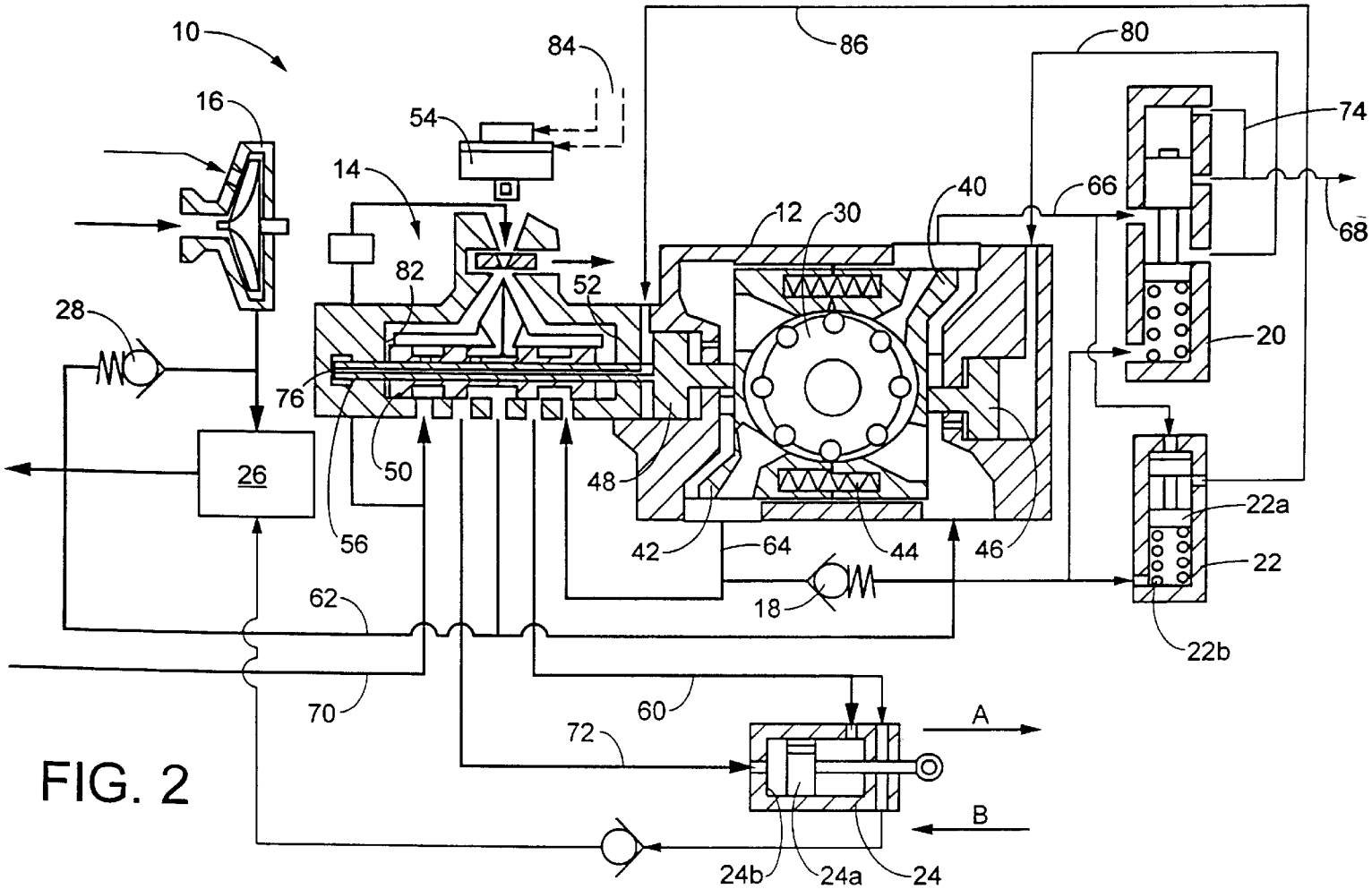
FIG. 2 is a pumping system schematic illustrating a control system for a variable exhaust nozzle on a gas turbine engine in a variable exhaust nozzle control mode in accordance with a first preferred embodiment of the present invention.

With reference to FIGS. 1 and 2, one application of the present invention that provides independently controllable circuits is shown. Specifically, a control system 10 is provided for the actuation of a jet engine variable exhaust nozzle and for providing engine start flow. The system 10 generally comprises a pump assembly of a variable displacement pump type 12, a four-way electro-hydraulic servo valve (EHSV) 14, a full flow boost stage 16, a high pressure relief valve 18, a start regulator valve 20, a de-stroke compensator valve 22, an actuator 24, a filter 26, and a filter bypass valve 28. The system 10 is capable of being selectively operated in a start-up mode for use during the start-up of an aircraft engine (not shown) and a VEN control mode for use as a variable exhaust nozzle actuation system. Of course, these applications are merely exemplary of the benefits offered by this invention; however, one skilled in the pump art will appreciate the potential use of the assembly in related or similar applications.

The control system 10 preferably uses a variable displacement pump 12 as its primary pump assembly with dual independent pump function capability. The pump has a rotor 30 operatively rotating within opposing cam sections or segments, namely, a start flow cam section 40 and a variable exhaust nozzle (VEN) cam section 42. The cam sections 40, 42 are each selectively and independently movable between a zero displacement position and a maximum displacement position with respect to a centerline of the rotor 30.

More specifically, biasing member(s) or cam section separating springs 44 apply a spring force against the cam sections 40, 42 and tend to urge cam sections 40, 42 toward their respective positions of maximum displacement. Opposing pistons, namely, start flow piston 46 for start flow cam section 40 and VEN piston 48 for VEN cam section 42, are used for moving and maintaining each cam section in a desired position against the springs 44. Movement of the pistons 46, 48 depends on the amount of force applied to the pistons against the springs 44.

For example, if the force applied to piston 46 is less than the spring force, cam section 40 will move toward its position of maximum displacement. If the force applied to piston 46 is greater than the spring force, cam section 40 will move toward its position of minimum displacement. If the force applied to the piston 46 is equal to the spring force, cam section 40 will not move toward either position. The variable displacement pump 12 described herein and further described in co-pending application Serial No. that claims the benefit of U.S. provisional application Serial No. 60/148,828 is but one embodiment of a variable displacement pump for use in conjunction with the present invention.

An outer spool 50 is movably received within the EHSV 14. The outer spool 50 is selectively moveable between an engine start position (where the outer spool is abutted against pump side stop 52) and first and second VEN positions. The start position is for use during start-up mode and the VEN positions are for use during the VEN control mode. Movement of the outer spool 50 to the start position or any of the VEN positions is commanded by the EHSV logic 54.

An inner spool 56 (or tracking servo valve) is movably received within the outer spool 50 of the valve 14. The inner spool is selectively moveable between a first or maximum stroke stop position and a second position. Movement of the inner spool is controlled by the EHSV logic 54 which responds to an input current.

The actuator 24 serves to apply a force for an associated function, for example, controlling the geometry of an exhaust nozzle. The loading on the actuators is typically unidirectional and exhibits a lighter loading in the extend direction A. The unidirectional load is most significant in the retract direction B of actuator. This skewed load characteristic makes the present invention ideal for providing variable adjustment of the loaded actuators.

At engine start-up (FIG. 1), the outer spool 50 is moved to its start position for engine start-up mode. In this position, the outer spool 50 causes rod side line 60 of the actuator 24 to be in communication with boost stage pressure through line 62. The outer spool also prevents any pump discharge flow from entering pump discharge line 64 and being fed to the rod end of the actuator through line 60 during start-up of the aircraft engine. Rather, all available pump discharge flow, from both sides of the pump, exits the pump through start flow pump discharge line 66. Discharge line 66 is internally connected to line 64. This pump discharge line 66 communicates with the start regulator valve 20 into the start flow line 68. Further, the main pump discharge flowing through line 70 is prevented from entering the head side line 72 by the start position of the outer spool.

During the engine starting mode, the inner spool 56 is at the maximum stroke stop position shown in FIG. 1. As is evident, the maximum stroke stop position is set by the position of the VEN piston 48. In this position, the inner spool 56 establishes fluid communication between the boost stage line 62 and the inner spool conduit 76 which feeds boost stage pressure to the VEN piston 48.

Maximum pump output flow is required from the pumping system 10 during the start-up mode to provide fluid to the start flow line 68 of the aircraft engine. Maximum pump output flow for the start flow line 68 is achieved by positioning both cam sections 40, 42 at their respective maximum displacement positions. The force exerted on the VEN side piston 48 results from the boost stage pressure line 62 as directed by the port provided in the outer spool that communicates with the passage in inner spool 76. The force is less than the spring force causing cam section 42 to move to its maximum of full displacement position. Likewise, the start side piston 46 has a force acting on the piston 46 that is less than the spring force and moves to its maximum or full displacement position.

Operating with the cam sections 40, 42 in their maximum displacement positions, the pump 12 provides maximum fluid to the start flow pump discharge line 66. The fluid in the start flow pump discharge line 66 is routed through the start regulator valve 20. In a first or closed position shown in FIG. 1, all of the fluid entering start valve 20 is directed to the start flow line 68 for satisfying the downstream start flow requirements. The de-stroke compensator valve 22 is also in a first or closed position during the startup mode rendering the valve 22 essentially inactive.

During the starting mode, the position of the actuator is independent of the remainder of the system. Boost stage pressure feeds both the rod and head ends of the actuator so that no net force is exerted thereon.

Once a predetermined pressure has been achieved in the start flow line 68, the start regulator valve 20 acts to cut-off fluid flowing to the start flow line 68 by moving to an open position. This is accomplished through line 74 that branches from the start flow line 68 and acts on the end of the valve spool 76 and overcomes the biasing force of spring 78 acting on the other end of the spool. In the open position (FIG. 2), a portion of fluid entering the regulator valve 20 is redirected to line 80 and thereby de-strokes the start flow piston 46. The start flow cam section 40 is urged toward and held at its position of minimum displacement in response to the increase in the downstream start flow pressure, thereby essentially shutting off the start side of the pump (FIG. 2). It should be noted that due to the restrictions in the start valve 20, flow exiting the start valve 20 will be at a slightly lower pressure than the flow exiting the pump 12.

With the start flow cam section 40 maintained in its minimum displacement position, the system 10 operates solely by the selective movement of the VEN cam section 42. The VEN cam section 42 of the pump 12 moves between its minimum and maximum displacement positions dependent upon the requirements of the system 10. The start flow cam section 40 acts only to balance the hydraulic loads within the pump 12. The system 10 is now in VEN control mode and operates to supply variable flow and pressure to the rod side of the actuator via line 64, the valve 14, and line 60 of the system 10. The fluid in the rod side line 60 acts on the actuator either extend (reference arrow A) or retract (reference arrow B) on the rod.

During the VEN control mode (i.e., after the start regulator has cut off start flow), the outer spool 50 is variable between the first and second positions depending on the desired position of the actuator 24. The spool position is dependent on the EHSV control. In a first VEN position shown in FIG. 2, the outer spool 50 is moved toward the VEN side stop 82. While in this VEN position, the outer spool 50 causes the line 72 that communicates with the head side of the actuator to be connected to the boost stage pressure line 62. The rod side of the actuator is connected to the VEN side pump discharge 64 through line 60. The pressure of the fluid flowing into the rod side line 60 is greater than the pressure of the fluid flowing in the head side line 72 thereby causing the actuator 24 to retract, i.e., the actuator piston 24*a* will move into the actuator housing 24*b*. An input current 84 to the EHSV 14 prompts movement of the outer spool 50 thereby controlling the slew direction and rate of movement of the actuator 24.

In response to an EHSV input current command 84 to retract the actuator 24, the position of the outer spool 50 is altered. As a result, fluid discharged from the pump 12 through the VEN discharge line 64 is routed to the rod side line 60 of the actuator valve 24. The pump 12 then produces, in the rod side line 60, the pressure required to retract the actuator. The head side line 72 of the actuator valve 24 is connected to a low pressure source by the outer spool 50 of the EHSV 14 during a command to retract.

Responsive to a command to extend the actuator, the outer spool 50 moves to a position between the VEN side stop 82 and the start side stop 52 causing the head side line to be connected to the main pump discharge line 70 and causing the rod side line 60 to be connected to the boost stage pressure line 62. The pressure of the fluid flowing into the head side line 72 is greater than the pressure of the fluid flowing into the rod side line 60 thereby causing the actuator 24 to extend, i.e., the actuator piston 24*a* will move out of the actuator housing 24*b*.

The extend rate of the actuator 24 is controlled by throttling flow to the head side line 72 through the EHSV 14. The retract rates of the actuator are set by positioning the VEN cam section 40 to a desired intermediate position between its maximum and minimum displacement positions. The VEN cam section 40 is moved by the VEN piston 48 which moves proportionally to the input current sent to the EHSV 14.

During VEN mode, the inner spool 56 moves between first and second positions as required to balance out the pressure in the system 10. If the pressures become higher than desired, the inner spool 56 connects the inner spool conduit 76 to the main pump discharge pressure line 70 thereby de-stroking the VEN cam section 42 of the pump 12, i.e., increasing the pressure force on VEN cam piston 48, such that the VEN cam section 42 moves toward its minimum displacement position. If increased pressure or flow is required, the inner spool 56 communicates with the boost stage pressure line 62 thereby relieving the pressure on the VEN cam piston 48 and causing the VEN cam section 42 to move, toward its maximum displacement position.

To prevent over pressurization of the engine downstream components, pressure relieving safety features are provided in the system 10. These features include a de-stroke compensator valve 22 and a high pressure relief valve 18. The de-stroke compensator valve 22 prevents the discharge pressure of pump 12 from becoming too high. The de-stroke compensator valve 22 typically covers all system failures external to the pump 12 such as actuator 24 overload or control system failures which result when the actuator 24 engages physical stops. The high pressure relief valve 18 is provided for preventing over pressurization of the system 10. The high pressure relief valve 18 provides protection to the system in the event of pump failures which will not allow the de-stoking action of the de-stroke compensator valve 22 to occur.

The de-stroke compensator valve 22 only becomes active with large pump discharge pressures. More specifically, the de-stroke compensator valve 22 limits the pump output pressure to a preset level by "de-stroking" the pump 12 to a reduced displacement. The de-stroke valve 22 does this by providing a high pressure feed through line 86 to the VEN side cam piston 48 of the pump 12 which causes the pump 12 to de-stroke thereby reducing the displacement of cam section 42 and preventing over pressurization. The valve 22 is movable from a normal mode first position to a compensating mode second position.

When the valve 22 is in the first position, the VEN pump discharge pressure in line 66 acts on one end of the valve spool 22*a* but is not great enough to overcome the combined force from boost stage pressure in line 62 and the valve spring 22*b*, which act on the other end of the spool 22*a*. This results in the valve 22 preventing fluid communication between discharge conduit 66 and high pressure feed in line 86. For this condition, pressure on the VEN side cam piston 48 is kept modulated by the pressure of the main pump discharge 70 that reaches the VEN side cam piston through communicating ports and passages in the outer and inner spools. In the normal mode, the discharge conduit 66 is at the highest pressure, the VEN side cam piston 48 is at an intermediate pressure from main pump discharge 70, and the boost stage pressure line 62 is at the lowest pressure.

When the valve 22 is in the second position (not shown), the VEN pump discharge pressure of discharge conduit 66 becomes great enough to overcome the force from the boost stage pressure line 62 and the spring 22*b*. This causes the valve 22 to allow fluid communication between discharge conduit 66 and high pressure feed line 86. Since the VEN side cam piston 48 is now under high pressure, the cam 48 will move and the VEN side of the pump 12 will de-stroke. This de-stroke will reduce the pump displacement and discharge pressure. Also, it will stabilize the compensating valve pressure setting. In the compensating mode, the highest pressure is in the discharge conduit 66, the VEN side cam piston 48 is at an intermediate pressure, and the boost stage pressure line 62 is at the lowest pressure.

The high pressure relief valve 18 is included as another backup feature to prevent the system 10 from over pressurization. Normally, in the event of system over pressurization, the de-stroke compensator valve 22 would activate and de-stroke the pump 12, thereby reducing the pump discharge pressure 64, 66. If the de-stroke compensator valve 22 fails, or fails to move the VEN side cam 42 on the pump 12, the high pressure relief valve 18 activates and controls the over pressurization.

Figure 3:
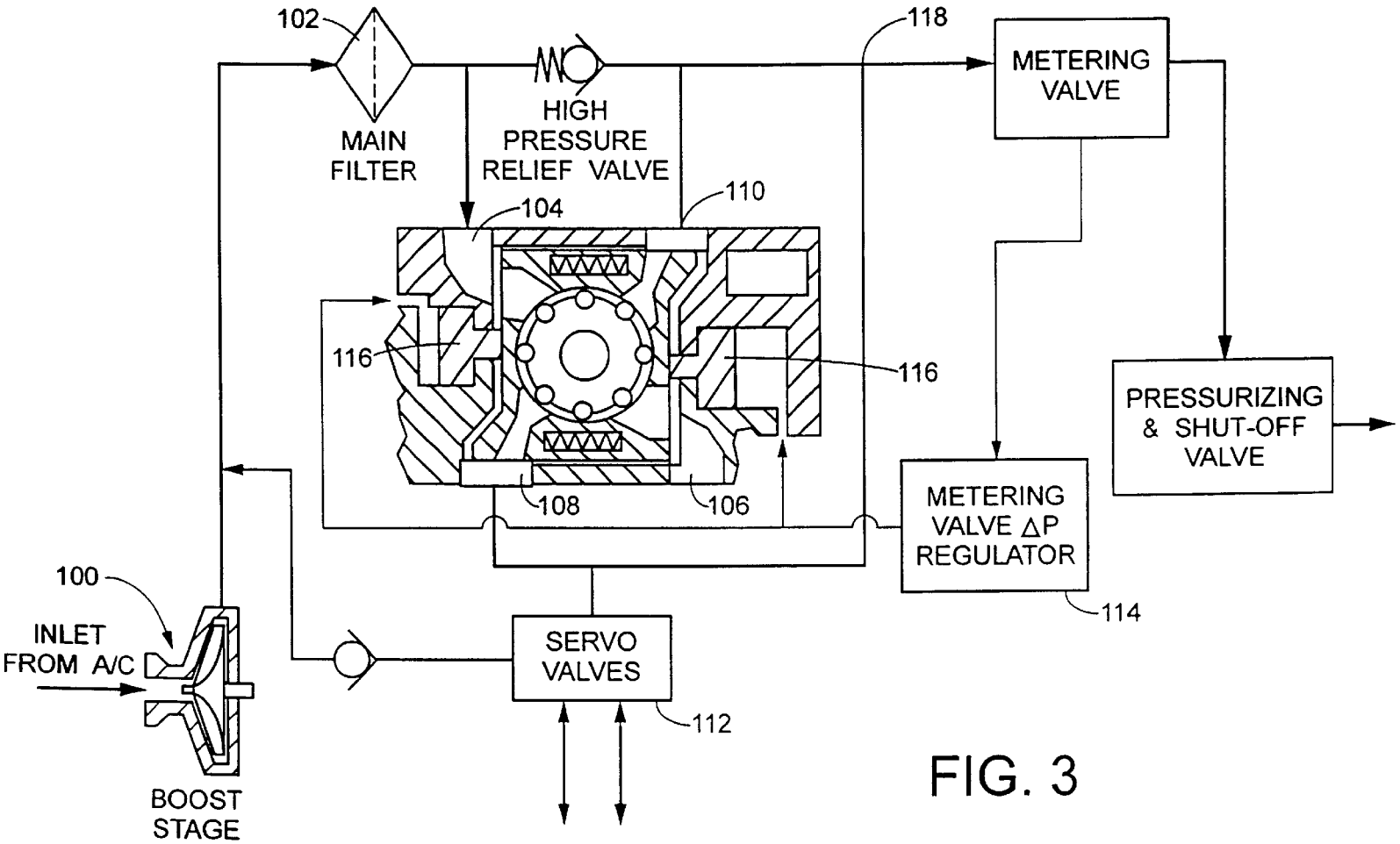
FIG. 3 illustrates another application of the present invention as an alternative to a conventional variable displacement vane pump (VDVP).

FIG. 3 illustrates an application of the variable displacement roller pump (VDRP) for use in performing variable displacement pumping only. Flow from the boost stage 100 passes through a filter 102 before entering a first inlet 104 of the VDRP described in the noted commonly assigned application. Flow also reaches the second inlet 106. The pressurized flow from the first circuit, or left-hand side of the pump housing as shown, proceeds through outlet 108 and flow also exits via second outlet 110 from the second circuit or right-hand side of the pump housing. Although a portion of the flow from the outlets is used for related actuation uses represented by servo valves 112, the two circuits essentially act in tandem (as noted by the common control lines that lead from the metering valve delta P regulator 114 to the pistons 116 that control the cam rings associated with the two circuits). The flows from the outlets are combined at juncture 118 before entering a metering valve. Thus, it will be understood from this embodiment that the invention can also be used as an alternative to a conventional variable displacement vane pump. All of the beneficial attributes of the separate and independent circuits associated with a single structure are not used in this embodiment, but can still serve a wide variety of applications.

Figure 4:
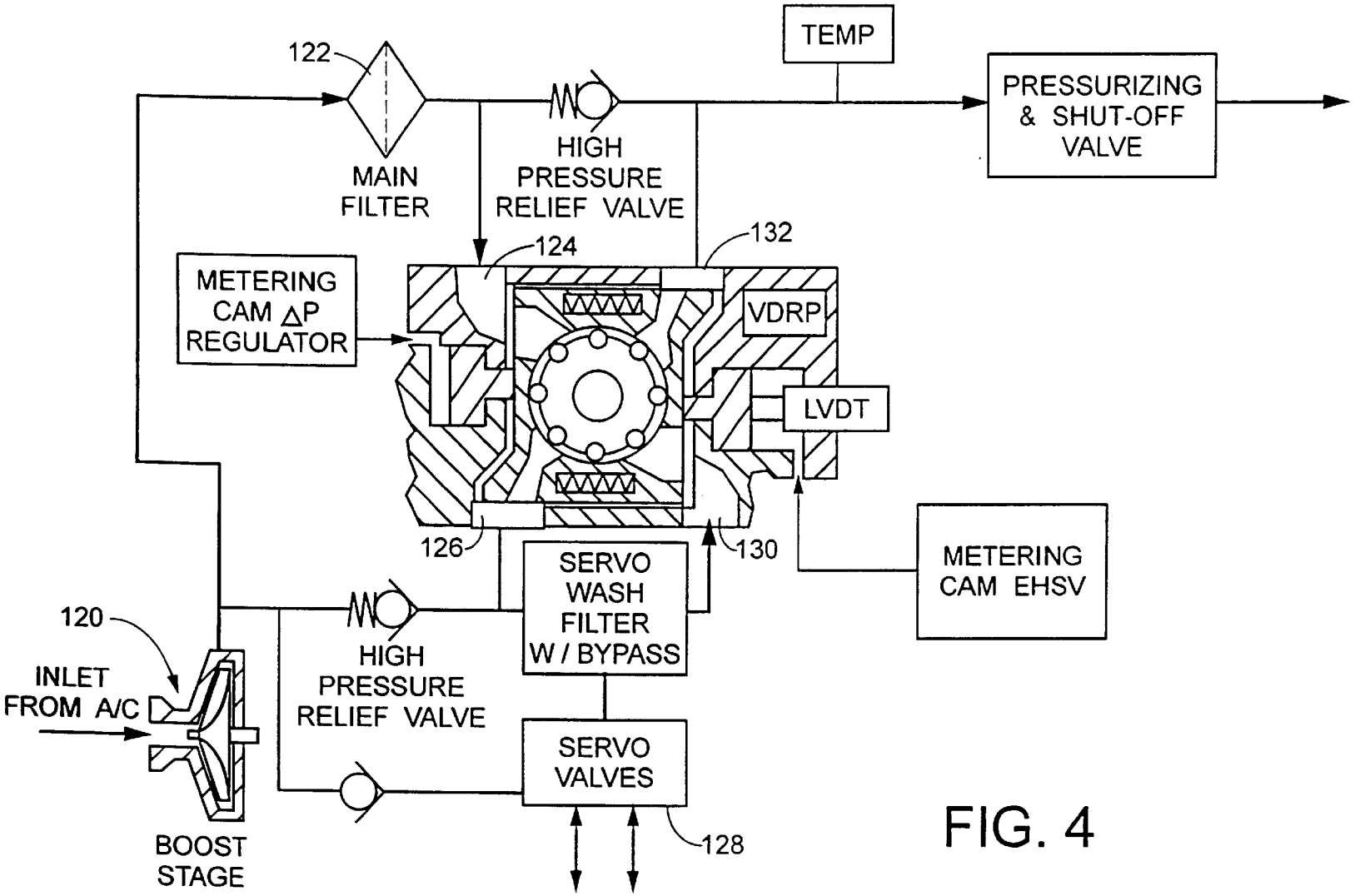
FIG. 4 is yet another application of the teachings of the present invention in pumping and metering environment.

On the other hand, FIG. 4 demonstrates the versatility and beneficial advantages offered by the independently controllable circuits of the VDRP. Particularly, flow from the boost stage 120 passes through filter 122 and enters first inlet 124. The left-hand side of the VDRP, or first circuit, pressurizes the fluid before it exits the first outlet 126. A portion of the pressurized fluid is again used for related actuation uses as schematically represented by servo valves 128. The fluid is next directed into second inlet 130 where the right-hand side, or second circuit, is independently operated from the first circuit. Thus, the first circuit provides, for example, high pressure pumping needs for the system and the second circuit serves as an accurate metering device. Although a bearing load is imposed on the VDRP, the bearing design can be preselected to accommodate the bearing needs. Thus, pumping and metering can be achieved with the same device.

The invention has been described with reference to the preferred embodiments. Obviously, modifications and alterations will occur to others upon reading and understanding the preceding detailed description. The exemplary embodiments should not be construed in any manner that limits the application offered by the VDRP where two independently controllable circuits can be used effectively. It is intended that the invention be construed as including all such modifications and alterations insofar as they come within the scope of the appended claims or the equivalents thereof.

Having thus described the preferred embodiments, the invention is now claimed to be:

1. A balanced variable displacement roller pump system comprising:

a housing having a rotor received therein for rotation about an axis;

first and second cam rings received in the housing, the cam rings being independently and selectively movable toward and away from the rotor to define first and second independently variable pumping sections;

a control assembly operatively associated with the cam rings for selectively altering positions of the first and second cam rings; and a biasing member urging the cam rings away from the rotor.

2. The pump system of claim 1 wherein the control assembly includes first and second control pistons for independently varying the position of the cam rings relative to the rotor.

3. The pump system of claim 1 further comprising first and second inlets and first and second outlets to the pump housing, the control assembly selectively shutting off flow through one of the outlets in response to a predetermined condition.

4. The pump system of claim 3 wherein the control assembly includes a first and second control pistons for independently varying the position of the cam rings relative to the rotor, the first control piston in selective communication with one of the outlets for altering the position of the first control piston in response to a preselected condition in the outlet.

5. A balanced variable displacement vane pump system comprising:

a housing having a rotor received therein for rotation about an axis;

first and second cam rings received in the housing and selectively movable toward and away from the rotor to define first and second independent pumping sections;

a control assembly operatively associated with the cam rings for selectively using the pumping sections in first and second, different modes of operation, and means for biasing the cam rings toward positions of maximum displacement.

6. The pump system of claim 5 and using only one pumping section during a second mode of operation.

* * * * *